United States Patent [19]

Osterkorn et al.

[11] 4,079,611

[45] Mar. 21, 1978

[54] STRIP TENSION CONTROL SYSTEM FOR THE PROTECTION OF FIN TUBING

[75] Inventors: Charles Louis Osterkorn, North Brunswick; Salvatore M. Marino, East Brunswick, both of N.J.

[73] Assignee: Fedders Corporation, Edison, N.J.

[21] Appl. No.: 735,904

[22] Filed: Oct. 26, 1976

[51] Int. Cl.[2] ..... B21D 43/08

[52] U.S. Cl. ..... 72/17; 72/183; 29/157.3 AH

[58] Field of Search ..... 113/1 C, 118 A, 118 B; 29/157.3 AH; 226/42, 44, 178; 72/17, 18, 183; 242/156.2

[56] References Cited

U.S. PATENT DOCUMENTS

| | | | |
|---|---|---|---|
| 794,433 | 7/1905 | Thibodeau | 72/17 |
| 2,661,525 | 12/1953 | Edwards | 113/118 A |
| 2,934,987 | 5/1960 | Rauline | 226/44 |
| 3,531,962 | 10/1970 | Menasoff | 72/17 |
| 3,652,820 | 3/1972 | Boose | 113/118 A |

*Primary Examiner*—Lowell A. Larson

*Attorney, Agent, or Firm*—McAulay, Fields, Fisher & Goldstein

[57] ABSTRACT

The invention is concerned with a system for monitoring the feed rate of a cut strip which is to be applied to a rotating tube for use in the production of fin tubing and includes a dancing roll to monitor the feed rate of the strip in response to the tension applied by the strip to the dancing roll as it is fed from a direct hydraulic drive during application to the rotating tube, the tension in the strip being maintained essentially constant throughout.

4 Claims, 1 Drawing Figure

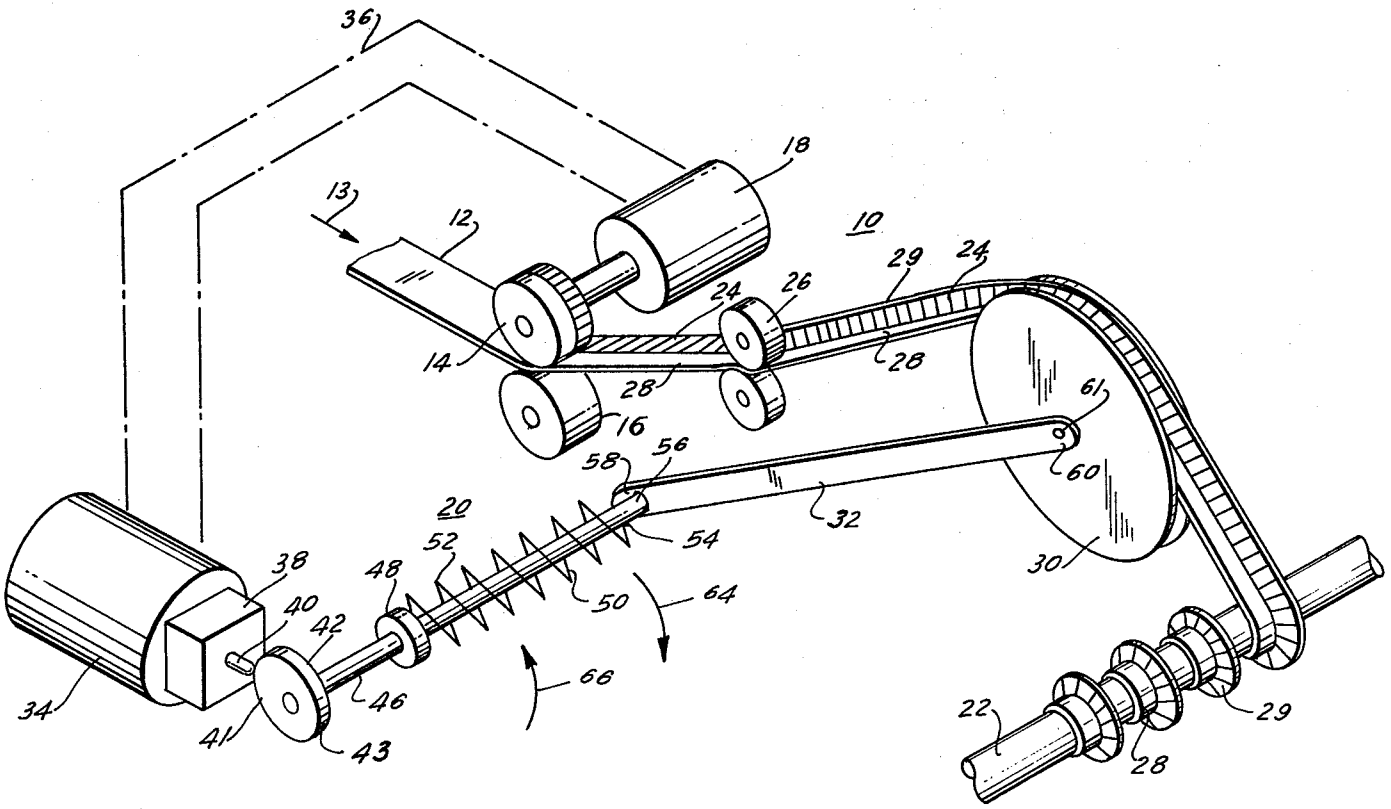
10
12
13
14
16
18
20
22
24
26
28
29
30
32
34
36
38
40
41
42
43
46
48
50
52
54
56
58
60
61
64
66

STRIP TENSION CONTROL SYSTEM FOR THE PROTECTION OF FIN TUBING

BACKGROUND OF THE INVENTION

This invention relates to a system for monitoring and controlling the feed rate of a cut strip material which is adapted to be applied to a rotating cylindrical surface for use in the manufacture of fin tubing.

In particular, in order to appreciate fully the inventive advance of the present invention over the prior art systems, consideration is to be given to a number of related controls which are of interest. In this respect, reference is made to U.S. Pat. No. 3,808,789 to Hurley which discloses a system in which a plurality of strands is fed to a winding device from a plurality of supply packages or rolls, to feed rolls, and around a tension controlling means. After passing through the feed rolls, the strands enter a tension sensing device and pass through an opening to be wound onto a spool. The tension sensing device specifically includes a member having side and end rods over which the strands are fed. Increases and decreases in the tnesion of the strands causes movement of the mechanism which operates a potentiometer so as to control a magnetic clutch. The shaft moves against a biasing weight and against the action of a damping cylinder. Variations in resistance in the potentiometer changes the degree of slip in a magetic clutch which control the rotational speed of the drive rollers and thereby controls the rate of feed of the strands and consequently the tension exerted. However, it should be noted that this patent specifically points out that the rate of rotation of the motor and of its output shaft does not vary.

Another patent which is of interest is McCoy, U.S. Pat. No. 2,978,196 which is directed to a control means to control wire tension in a wire moving from one stage of a processing operation to a second stage of a processing operation, in particular, as the wire is advanced from a drawing die. The system of the patent includes both a stationary sheave and a movable sheave about which the wire is wrapped; a third sheave is provided connected to a movable arm which is associated with switches adapted to control a reversible motor. The patent discloses variation in the tension of the wire and provides for the aforesaid switches should the movements of the movable sheave be insufficient to control the tension of the wire. While the patent does disclose a movable sheave connected to an arm in order to control the tension in the wire, the patent specifically requires two movable sheaves and switches responsive to a spring biasing means which prevents constant movement of the arm, and points out that while there is a change in the tension of the wire, it is only gross changes for which compensation is effected.

Another patent which is pertinent to the present invention is U.S. Pat. No. 2,903,635 to Brooke et al. which discloses a feeler switch adapted to shut off a machine feeding roll should there be excessive slackness in the sheet being fed from the roll. This patent describes a "jockey roll" which moves between two different position to control slackness in the sheet. When the slackness is excessive, the arm moves to one position causing a cam to move the arm against a time delay switch. If the arm remains in this position for a sufficient period of time, the apparatus is shut off. There is no disclosure of a continuous variation in feed rate.

U.S. Pat. No. 3,613,975 to Knight also discloses a tension control system, and specifically an electronic control system for maintaining a predetermined tension in a material which is fed from a feed to a take-up station. Tension control is accomplished by means of a roller which moves within a guided pathway from a fixed position so as to activate a variety of electrical controls either to speed up or to slow down the feed rate as the roller moves from a constant datum plane.

SUMMARY OF THE INVENTION

It is an object of the present invention to provide for a direct drive system for monitoring and controlling the feed rate of cut strip material which is fed by means of a hydraulic drive and adapted to be applied to a rotating tube.

A further object of the invention is the provision of a system for continuously monitoring and ajusting the feed rate of the strip material which is to be applied to a rotating tube.

A further object of the invention is to provide for a feedback system, continuously responsive to movement of the strip as it is fed to the rotating tube, so as to control and vary the feed rate of that strip to maintain the tension in the strip constant.

In the context of the present invention, reference is made to a dancing sheave. This means that while the sheave is always free to rotate about its own axis, the sheave is also free to revolve about another axis separate and apart from its own rotational axis. The dancing sheave, while it is free to revolve about its revolution axis, moves through a limited controlled arc of movement. This limited controlled arc of movement is limited in one direction by the material passing over the sheave and in the direction opposite to the one direction by another control member. The other control member generally urges the dancing sheave towards said one direction.

In order to accomplish the aforesaid objects, the present invention proposes to provide for a conveyor system including a tension responsive feed means, preferably a variable speed hydraulic drive to feed a strip of material which is suitably stamped and guided to pass over the dancing sheave to a continuously rotating circular member or tube, which rotates at an essentially constant speed. For this purpose the dancing sheave is connected to a feedback system for controlling the speed of a variable speed motor and thereby controlling the feed rate so that the tension in the strip material as it passes over the sheave and is applied to the rotating tube is maintained substantially constant. The feedback system effectively and continuously monitors the tension in the strip and includes a long arm having two ends, one end of which is a free floating end connected to the dancing sheave. The other end of the long arm in turn is connected with a speed control responsive device which includes a torsion spring. The feedback system is activated to control the speed of the variable speed hydraulic motor so as to maintain a substantially constant tension in the strip material as it is applied to the rotating tube.

The speed control responsive device includes a rotatable shaft fixedly connected to the other end of the long arm for rotation therewith. The shaft rotates in response to the direction of movement of the long arm as a result of the tension in the strip material passing over the sheave. The other end of the long arm is also connected with one end of the torsion spring. The other end of the torsion spring is connected with a bearing in which the rotatable shaft passes through and is held for rotational movement under the control of the torsion spring and the long arm. The torsion spring is effective to cause the long arm to rotate in a direction so as to maintain the dancing sheave in contact with the strip material and to maintain the tension in the strip constant based upon that contact. Should the tension in the strip be reduced, due to the feed rate being greater than can be accommodated by the rotating tube, the torsion spring rotates the long arm together with the shaft so as to decrease the feed rate of the strip material and, thus, maintain the substantially constant tension in the strip. The long arm is effective to overcome the torsion force in the spring and to rotate the spring and shaft in one direction as the tension in the strip material increases. And, as the tension on the strip material decreases, the torsion spring is effective to cause the rotation of the shaft in a direction opposite to the aforesaid one direction under the guidance of the long arm and the sheave. The other end of the shaft is connected with a speed control device to control the speed of the variable speed hydraulic motor. The speed control device includes a cam connected to the other end of the shaft. The cam has an eccentric portion adapted to move a plunger forming part of the hydraulic circuit for the variable speed hydraulic motor. Thus, as the plunger is actuated, the speed of the variable speed hydraulic motor is increased or decreased, based upon the variations sensed in the tension of the strip.

The invention permits compensation for variations in thickness of the rotating tube, or in its speed of rotation, so as to provide a sufficient rate of feed of the strip to the tube. This is accomplished by maintaining the tension in the strip substantially constant as it is applied to the tube. As a result of this control, higher production speeds are obtainable.

Higher production speeds are obtainable because of the fine control over the tension of the strip material as it is applied to a tube or cylinder. By maintaining the tension of the strip material substantially constant, the tendency for breakage of the strip material is reduced. Since there is less tendency for the strip material to break, the down time which would result from the necessity to repair the break is reduced, and the tube can be rotated at higher speed because of the fine control placed on strip tension.

By controlling the rate of speed at which a pair of gears connected with the hydraulic motor are driven, the feed rate of the cut strip is varied in response to the tension in the strip at the point of application to the roller or tube, so that an increase in tension at that point causes a higher rate of feed, while a decrease in tension causes a lower rate of feed.

BRIEF DESCRIPTION OF THE DRAWINGS

Other objects and advantages of the invention will become readily apparent and obvious to those skilled in the art from the following specification and claims which include a preferred embodiment of the present invention and from a single FIGURE of the drawings which schematically and in perspective shows the system for monitoring and continuously controlling the feed rate of a cut strip of material adapted for application to a tube for use in the manufacture of finned tubing.

DESCRIPTION OF THE PREFERRED EMBODIMENT

Referring now more particularly to the single FIGURE of the drawing, the system 10 for monitoring and controlling the feed rate of a cut strip of material 12 is shown, in which the strip material is fed in the direction of the arrow 13 from a conventional supply reel (not shown) to a pair of gears which includes a cutting gear 14 and a follower gear 16 held in mating relationship with each other. Gear 14 is driven by a variable speed hydraulic motor 18 whose speed is controlled by a feedback circuit 20.

Strip 12, after suitable formation by cutting gear 14, is ultimately applied to a roller, cylinder or tube 22. Strip material 12, immediately after being cut by cutting gear 14, is formed into a cut portion 24 and uncut portion 28. The cut portion 24 and uncut portion 28, which at this point still are coplanar, are then passed between a pair of guides to accomplish the bending of the cut portion 24 into a position substantially perpendicular or normal to uncut portion 28. After bending of the cut portion 24 so that it is transverse to, and no longer coplanar with the uncut portion 28, the cut portion 24 is effectively formed into fins 29 attached to and extending substantially normally from the uncut portion 28, the latter forming a collar for attachment to tube 22. Tube 22 rotates at an essentially constant rate of speed, and the strip 12, after formation into collar 28 and fins 29, is fed over a dancing roll in the form of a sheave 30, with the portion 28 in contact with the peripheral surface of sheave 30. As noted heretofore, the tube 22 rotates at an essentially constant speed, and in order that the tension of the strip material as it is fed to tube 22 be maintained substantially constant, the dancing roll in the form of sheave 30 is provided to sense any increase or decrease in tension in the strip material between guides 26 and tube 22. The sheave 30 hereinafter may also be referred to as a dancing sheave for the sake of simplicity in terminology.

The feedback circuit 20 includes a long arm 32 connected with sheave 30, a pump 34 (provided with a source of power, not shown) which is adapted to supply an incompressible fluid, such as oil, to a tension responsive feed means such as the variable speed hydraulic motor 18 through lines 36 so as to continuously increase or decrease the speed of the motor 18 and thereby regulate the speed of the strip 12. Feedback circuit 20 also includes valve 38 connected with pump 34, a plunger 40 to operate the valve 38, and a cam 42 to control the movement of plunger 40; cam 42 is eccentrically connected with shaft 46 supported in bearing 48. A torsion spring 50 is wound around shaft 46, one end 52 of the torsion spring being fixed to bearing 48 and the other end 54 of the torsion spring being coupled to end 56 of shaft 46. Shaft 46 passes through bearing 48 and is held therein for rotational movement. One end 58 of the long arm 32 is fixedly connected both to end 56 of shaft 56 and spring end 54. The other end of long arm 32 is connected at its end 60 about axle 61 to sheave 30 to form a rotation axis through axle 61. This permits relative rotation of sheave 30 about rotation axis 61 with respect to long arm 32, while permitting long arm 32, together with shaft 46, to rotate about the axis of shaft 46 in response to the combined action of tension in the cut strip material 12 and the torsion spring 50. In effect, sheave 30 rotates about axis 61 and revolves about the axis formed by shaft 46 to rotate cam 42. Cam 42 is provided with an eccentric portion 41 and a cam surface 43 in contact with plunger 40.

In the operation of the strip tension control system 10, the tube or roller 22 rotates at a substantially uniform rate and the cut strip or finned material 24 is applied at substantially uniform tension. For this purpose, the strip material 12 is fed at a rate of speed controlled by means of the variable speed hydraulic motor. The strip material is first serrated or cut by cutting gear 14. The strip is then passed between guides 26 so as to bend the cut strip material and place the cut portion 24 into a perpendicular relationship to the portion 28. Extending fins 29 are formed from cut portion 24. The first portion 28 is then passed over the surface 31 of the sheave 30 which rotates about the axis 61 at end 60 of the long arm 32 while permitting the sheave 30 to revolve about the axis of shaft 46. If the tension in the cut strip material increases, which can be caused by an effective increase in the rate of speed of the rotating tube caused, for example, by an increased diameter of the tube, the sheave 30 revolves about shaft 46 and rotates long arm 32 about the axis of shaft 46 in the direction of arrow 64. The long arm 32 and shaft 46 are connected together so that both rotate about the axis of shaft 46.

As shaft 46 rotates in the direction of arrow 64, an indication is provided in the feedback circuit 20 that the speed of the motor 18 should be increased to increase the feed of strip material 12 between gears 14, 16. And, as the tension in the cut material 28, 29 decreases, thereby indicating that there is an effective reduction in the speed of the rotating tube, an indication is provided to motor 18 to have its speed decreased. In this situation, when there is a reduction of the tension in cut material 28, 29, the dancing sheave 30 under the control of the torsion spring 50 is caused to revolve about the axis of shaft 46 in the direction of arrow 66 to maintain substantially constant tension in the cut material 28, 29. Revolving of sheave 30 about shaft 46 in the direction of the arrow 66 is accomplished by means of the force imparted by the torsion spring 50 to shaft 46. Shaft 46 also rotates cam 41 in the direction of arrow 66. Shaft 46, by virtue of its long arm connection 32 with sheave 30, and by virtue of its connection with cam 42, provides direct feedback information to hydraulic motor 18.

Plunger 40 is adapted to ride on the cam edge or surface 43 of the eccentric portion 41 so as to move the plunger inwardly or outwardly, depending upon the angular position of shaft 46 and the position of sheave 30, to thereby increase or decrease the speed of motor 18 so as to maintain the tension in the strip material 28, 29 substantially constant as it passes over sheave 30. This insures that the cut strip material is applied to roller 22 at a desired rate.

By controlling the speed at which the gears 14 and 16 are driven, the feed rate of the cut strip is varied in response to the tension in the strip at the point of application to the rotating tube 22. Thus, an increase in tension causes a higher rate of feed, while a descrease in tension causes a lower rate of feed.

The torsion spring 50 which is connected to the end 58 of the long arm 32 is effective to maintain sheave 30 in contact with the cut strip material 24 as it passes over the sheave 30 in response to any decrease in tension so as to rotate shaft 46 in the direction of arrow 66. Rotation of the shaft 46 in the direction of arrow 66 causes the eccentric portion 41 to push the plunger 40 inwardly into the valve 38 and thereby causes pump 34 to supply less oil to the variable speed hydraulic motor 18 through lines 36 thus decreasing the speed of the motor 18. As the tension applied to sheave 30 is increased by the finned strip material 28, 29, the long arm 32 is effective to rotate shaft 46 in the direction of arrow 64, so as to rotate cam 42 and to permit plunger 40 to move out of valve 38, thus causing more oil to be pumped through lines 36 to the variable speed motor 18. Thereby the speed of the motor is increased to cause a higher rate of feed.

It is believed that the substance and method of carrying out the present invention has been shown in this application. It will be appreciated that because of the manner in which the system is constructed, the response of the strip feed rate to variations in the tension of the strip are, essentially, instantaneous. Thus, actual variation in the tension of the strip is extremely small. The prior art methods of dealing with this problem have not allowed for these instantaneous changes in strip feed rate to compensate for whatever differences in tension might be produced during utilization of the cut strip.

While there has been shown what is considered to be a preferred embodiment of the invention, it will be obvious to those skilled in the art that many changes and modifications may be made therein without departing from the spirit and scope of the invention.

We claim:

1. In a system for monitoring and controlling the feed rate of a strip material adapted for application to a rotating cylindrical surface for use in the manufacture of finned tubing, said strip material being at a substantially uniform and substantially constant tension, said system including a cutting gear mechanism for cutting strip material and forming it into found strip material for application to the cylindrical surface, the improvement comprising:

a. a movable sheave, interposed between said cutting gear mechanism and said cylindrical surface, movable in response to tension in the strip material;

b. a tension responsive feed means for feeding strip material to the cutting gear mechanism at a rate to maintain the tension in the cut strip material substantially constant as it is applied to the cylindrical surface;

c. the cut strip material being effectively fixed between said cutting gear mechanism and said cylindrical surface such that an increase in the rate of feed to said cutting gear mechanism decreases the tension applied by the cut strip material to said sheave and a decrease in the rate of feed to said cutting gear mechanism increases the tension applied by the cut strip material to said sheave; and d. a feedback circuit interconnecting said movable sheave and said tension responsive feed means continuously in response to the tension applied to said movable sheave.

2. The system as claimed in claim 1, wherein said tension responsive feed means comprises a variable speed hydraulic motor coupled with said feedback circuit, said feedback circuit including an oil pump for supplying different quantities of oil to said variable speed hydraulic motor related to the tension in the strip material.

3. The system as claimed in claim 2, said feedback circuit additionally including:

a. a rotatable torsion spring connection operatively connected to said movable sheave;

b. a long arm having one end connected with said movable sheave and another end connected with one end of said torsion spring, said sheave being rotatably connected with said one end of said long arm and revolvably connected with said other end of said long arm and said one end of said torsion spring to rotate as the cut strip material is fed over said sheave from the cutting gear mechanism to the cylindrical surface;

c. a valve coupled with said oil pump to control the quantity of oil pumped to said variable speed hydraulic motor;

d. a cam connected with the other end of said torsion spring connection, said cam having an eccentric portion; and e. a plunger connected with said valve and in contact with said cam, said eccentric portion being effective to actuate said plunger to control the quantity of oil pumped by said oil pump to said variable speed hydraulic motor to control the speed of the strip material as it is fed to the cutting gear mechanism.

4. In a system for monitoring and controlling the feed rate of a strip material which is adapted to be cut and formed into fins for application, under substantially constant tension, to a rotating tube for use in the manufacture of finned tubing, the system including means to rotate the tube at a substantially constant rate, and means to feed and to cut the strip material to form fins, wherein the improvement comprises:

a. a hydraulic means connected with said feed and cutting means to continuously adjust the feed rate of the cut strip material to the rotating tube;

b. a dancing member positioned intermediate said feed and cutting means and the rotating tube to sense variations in tension in the strip material;

c. a cam operated pump adapted to supply oil to said hydraulic means to control the speed thereof responsive to the tension applied to said member so as to control the rate of said feed and cutting means, and a cam associated with said pump for controlling the pumping rate thereof; and d. means to translate the tension applied to said member to said pump including an arm having one end operatively associated with said cam, a torsion spring mechanism torsionally connecting said cam and said one end, said dancing member being rotatable connected to the other end of said arm, said arm and said member having joint and unitary limited movement transverse to their interconnection in accordance with the spring action of said torsion spring and the tension applied by the strip to said dancing member; said dancing member being rotatable about said other end of said arm as the strip material passes thereover for application to the rotating tube and revolvable with said arm about said one end thereof to rotate said torsion spring mechanism and said cam to increase the speed of said hydraulic means as the tension in the coil strip material is increased and to decrease the speed of said hydraulic means as the tension is decreased, said pump being controlled by said torsion spring mechanism to vary the pumping rate of said pump.

* * * * *